US011402191B2

(12) United States Patent
Daly

(10) Patent No.: US 11,402,191 B2
(45) Date of Patent: Aug. 2, 2022

(54) EXPLOSIVE CHARGE DEACTIVATION SYSTEM AND METHOD

(71) Applicant: Expro Americas, LLC, Houston, TX (US)

(72) Inventor: Kerry G. Daly, Conroe, TX (US)

(73) Assignee: Expro Americas, LLC, Houston, TX (US)

( * ) Notice: Subject to any disclaimer, the term of this patent is extended or adjusted under 35 U.S.C. 154(b) by 155 days.

(21) Appl. No.: 16/888,949

(22) Filed: Jun. 1, 2020

(65) Prior Publication Data

US 2021/0372759 A1 Dec. 2, 2021

(51) Int. Cl.
*F42D 5/04* (2006.01)
*E21B 43/116* (2006.01)

(52) U.S. Cl.
CPC ..... *F42D 5/04* (2013.01); *E21B 43/116* (2013.01)

(58) Field of Classification Search
CPC ..... F42D 5/04
See application file for complete search history.

(56) References Cited

U.S. PATENT DOCUMENTS 5,392,860 A * 2/1995 Ross ..... E21B 23/065 102/222
6,120,627 A * 9/2000 Badger ..... C12P 1/00 149/108.8
8,754,284 B2 6/2014 Goodridge
8,850,984 B2 * 10/2014 Smylie ..... C06B 21/0091 102/314
9,714,199 B2 * 7/2017 Meeker ..... C06B 45/12
10,351,485 B1 * 7/2019 Decker ..... C12N 1/14
2011/0041718 A1 * 2/2011 Lubbe ..... F42C 15/44 102/200
2011/0056362 A1 * 3/2011 Yang ..... E21B 43/117 89/1.15
2012/0037368 A1 * 2/2012 Eick ..... C09K 8/706 166/300
2012/0282680 A1 11/2012 Goodridge
2015/0330757 A1 11/2015 Soohoo

OTHER PUBLICATIONS

International search report for PCT/US21/35160 dated Nov. 18, 2021.

* cited by examiner

*Primary Examiner* — Bret Hayes
(74) *Attorney, Agent, or Firm* — Getz Balich LLC

(57) ABSTRACT

A perforating gun assembly includes a body having an axial length extending between a first axial end and a second axial end, an outer radial surface extending between the first axial end and the second axial end, and an inner bore and at least one explosive charge extending from the outer radial surface to the inner bore. The at least one explosive charge includes a charge casing and a cavity liner mounted within the charge casing. The charge casing and the cavity liner define a charge cavity there between. The at least one explosive charge further includes an explosive material retained within the charge cavity. The at least one explosive charge further includes a deactivation composition retained within the charge cavity.

16 Claims, 5 Drawing Sheets

EXPLOSIVE CHARGE DEACTIVATION SYSTEM AND METHOD

BACKGROUND

1. Technical Field

This disclosure relates generally to explosive charges and, more particularly, to methods and systems for deactivation of said explosive charges.

2. Background Information

Explosives may frequently be used in oil and gas exploration and extraction, mining, and other industrial applications. Such explosives may include, for example, shaped charges, detonating cord, boosters, percussion igniters and initiators, etc. One challenge commonly encountered by explosive operators is the management of their explosive inventory. A particular project may require several different types and sizes of explosives in order to account for various conditions which may be encountered. Further, the explosive operator may prefer to have extra explosives on hand in the event they become necessary for the particular project. As a result, at the end of a project, unused explosive products may remain. In many countries, because of strict import and export laws, once these explosive products enter the country, it may not be possible to export them. These remaining explosives must be stored under strict conditions and may eventually exceed their allowable shelf-lives (typically five-years from the date of manufacture) without being used, thereby requiring disposal (e.g., destruction) of the remaining explosives. Depending on the location of the remaining explosives, various laws and/or government agencies may control or oversee the disposal of the remaining explosives and, in many cases, disposal of the remaining explosives can be expensive.

One reason that explosive disposal costs may be high is that even though designated shelf-life requirements may prohibit use of the explosive after a particular length of time, the explosive remains active, thereby requiring safe storage, handling, and ultimately, disposal. A common means for disposal of explosives is by open air burning (e.g., using diesel fuel) the explosive products, which presents environmental issues but renders the explosive deactivated and reduced to ashes and other discreet components. Unfortunately, some explosive products may contain heavy metals, lead, graphite, tungsten, or other dangerous material which, if not properly contained and disposed of, may create additional environmental hazards. A less common way to dispose of the explosive products is to dismantle the explosives into their core components, primarily by soaking the explosives in vats filled with water, alcohol, or other solvents and then working to remove the outer metal (aluminum, steel or zinc) shells or cases. Sonic vibration may assist with this process and does not pose a risk, however, the batch size is small, which extends the time and cost of disposal. This deactivation process may additionally produce contaminated water requiring additional costs for disposal. Accordingly, what is needed are improved methods and systems for deactivating explosives which address one or more of the above-discussed concerns.

SUMMARY

It should be understood that any or all of the features or embodiments described herein can be used or combined in any combination with each and every other feature or embodiment described herein unless expressly noted otherwise.

According to an aspect of the present disclosure, a perforating gun assembly includes a body having an axial length extending between a first axial end and a second axial end, an outer radial surface extending between the first axial end and the second axial end, and an inner bore and at least one explosive charge extending from the outer radial surface to the inner bore. The at least one explosive charge includes a charge casing and a cavity liner mounted within the charge casing. The charge casing and the cavity liner define a charge cavity there between. The at least one explosive charge further includes an explosive material retained within the charge cavity. The at least one explosive charge further includes a deactivation composition retained within the charge cavity.

In any of the aspects or embodiments described above and herein, the charge cavity is in fluid communication with the inner bore.

In any of the aspects or embodiments described above and herein, the at least one explosive charge further includes an adhesive disposed between and in contact with the explosive material and the cavity liner. The adhesive contains the deactivation composition.

In any of the aspects or embodiments described above and herein, the deactivation composition is disposed on an interior surface of the charge casing in contact with the explosive material.

In any of the aspects or embodiments described above and herein, the at least one explosive charge further includes a bonder intermixed with the explosive material. The binder contains the deactivation composition.

According to another aspect of the present disclosure, an explosive charge includes a charge casing and a cavity liner mounted within the charge casing. The charge casing and the cavity liner define a charge cavity there between. The explosive charge further includes an explosive material retained within the charge cavity. The explosive charge further includes a deactivation composition retained within the charge cavity.

In any of the aspects or embodiments described above and herein, the explosive charge further includes an adhesive disposed between and in contact with the explosive material and the cavity liner. The adhesive contains the deactivation composition.

In any of the aspects or embodiments described above and herein, the deactivation composition is disposed on an interior surface of the charge casing in contact with the explosive material.

In any of the aspects or embodiments described above and herein, the explosive charge further includes a binder intermixed with the explosive material. The binder contains the deactivation composition.

In any of the aspects or embodiments described above and herein, the deactivation composition includes a microorganism.

According to another aspect of the present disclosure, a method for deactivating an explosive charge includes providing the explosive charge including a charge casing and a cavity liner mounted within the charge casing. The charge casing and the cavity liner define a charge cavity there between. The explosive charge further includes an explosive material retained within the charge cavity. The method further includes deactivating the explosive charge with a deactivation composition retained within the charge cavity by causing the deactivation composition to transition from a dormant state to an active state.

In any of the aspects or embodiments described above and herein, the deactivation composition has a deactivation temperature range within which the deactivation composition transitions to the active state.

In any of the aspects or embodiments described above and herein, causing the deactivation composition to transition from a dormant state to an active state includes exposing the explosive charge to a temperature condition within the deactivation temperature range.

In any of the aspects or embodiments described above and herein, the deactivation temperature range is higher than a threshold temperature for the explosive charge.

In any of the aspects or embodiments described above and herein, the method further includes maintaining the explosive charge at a storage temperature less than the threshold temperature prior to deactivating the explosive charge.

In any of the aspects or embodiments described above and herein, the deactivation composition comprises a microorganism.

In any of the aspects or embodiments described above and herein, the explosive charge further includes an adhesive disposed between and in contact with the explosive material and the cavity liner. The adhesive contains the deactivation composition.

In any of the aspects or embodiments described above and herein, the method further includes degrading the adhesive causing the deactivation composition to interact with the explosive material.

In any of the aspects or embodiments described above and herein, the explosive charge further includes a binder intermixed with the explosive material. The binder contains the deactivation composition.

In any of the aspects or embodiments described above and herein, the method further includes degrading the binder causing the deactivation composition to interact with the explosive material.

The present disclosure, and all its aspects, embodiments and advantages associated therewith will become more readily apparent in view of the detailed description provided below, including the accompanying drawings.

DETAILED DESCRIPTION

Figure 1:
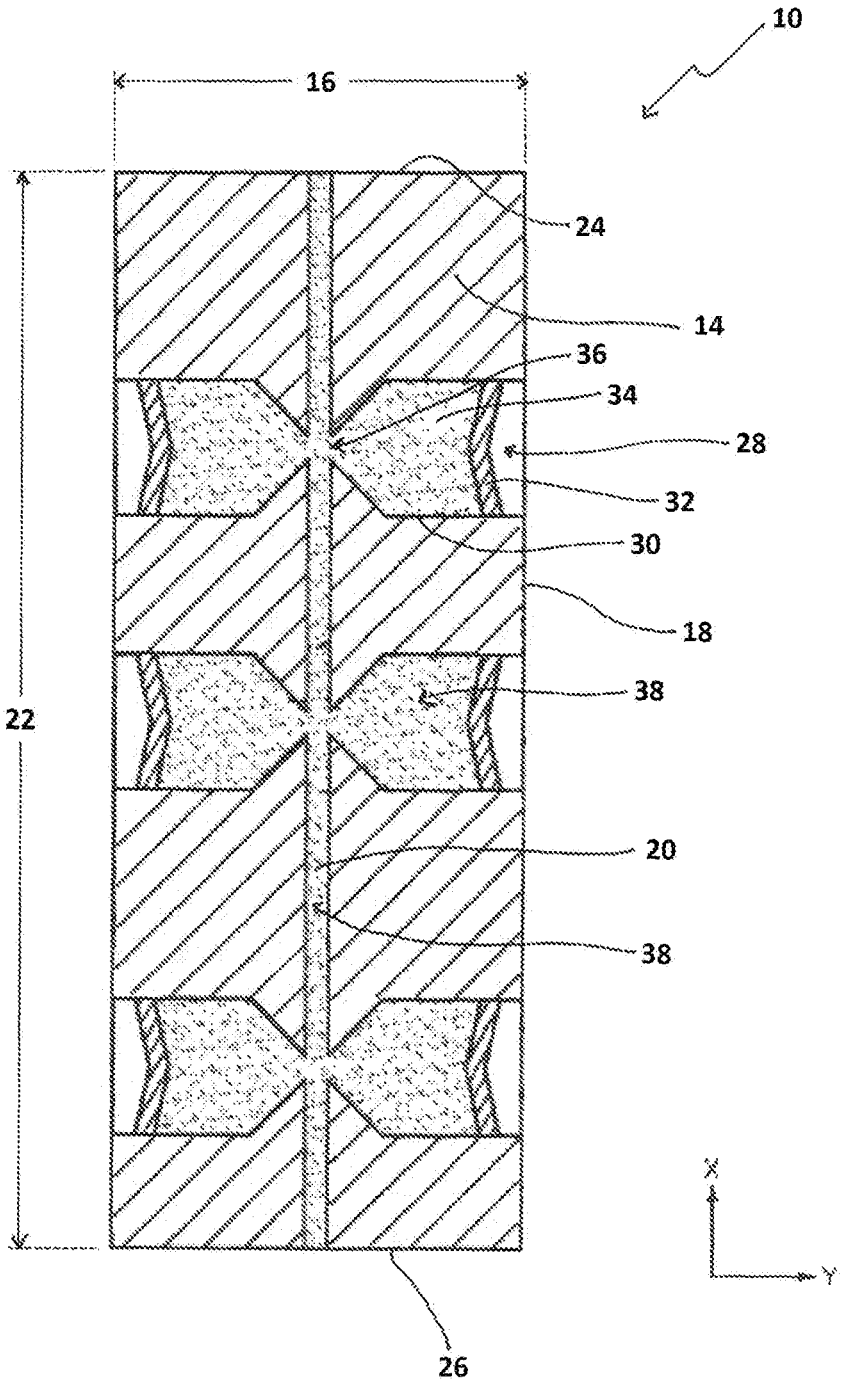
FIG. 1 illustrates perforating gun assembly, in accordance with one or more embodiments of the present disclosure.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As a person of skill in the art will recognize, other sequences of steps may be possible. Therefore, the particular order of the steps set forth in the description should not be construed as a limitation.

Referring to FIG. 1, an exemplary embodiment of a perforating gun assembly 10 is illustrated. The perforating gun assembly 10 includes a body 14 having an outer diameter 16, an outer radial surface 18, an inner bore 20, and an axial length 22. The outer diameter 16 extends radially (e.g., along a "Y" axis in the orthogonal axis illustrated in FIG. 1) between opposing portions of the outer radial surface 18. The axial length 22 extends axially (e.g., along a "X" axis in the orthogonal axis shown in FIG. 1) between a first axial end surface 24 and an opposing second axial end surface 26. The perforating gun assembly 10 embodiment shown in FIG. 1 is depicted as being cylindrical, but the present disclosure is not limited to a cylindrically shaped perforating gun assembly 10. In various embodiments, two or more perforating gun assemblies 10 may be coupled to one another in a variety of different ways; e.g., first axial end surface 24 to second axial end surface 26 by screw thread, mechanical fastener, etc. In various embodiments, the configuration of a first perforating gun assembly 10 may be different than the configuration of a second perforating gun assembly 10 coupled to the first perforating gun assembly 10.

Figure 5:
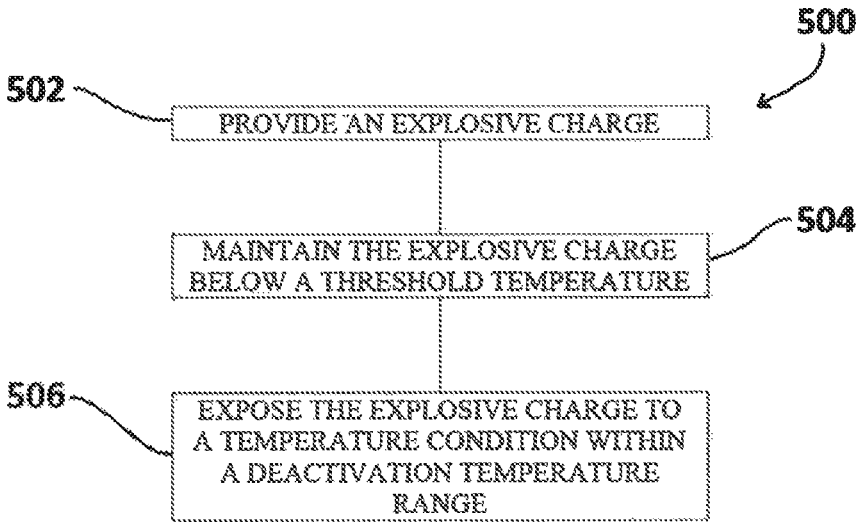
FIG. 5 illustrates a flow charge depicting a method for deactivating an explosive charge, in accordance with one or more embodiments of the present disclosure.

The body 14 of the perforating gun assembly 10 includes a plurality of shaped explosive charges 28 disposed in the outer radial surface 18 of the body 14 (see Step 502 of Method 500; FIG. 5). Each of the explosive charges 28 disposed within the body 14 may have the same geometry, or the plurality of explosive charges 28 may include different geometries. The present disclosure is not limited to any particular shape of the explosive charge 28. Each explosive charge 28 includes a charge casing 30, a cavity liner 32 mounted within the charge casing 30, and a charge cavity 34 defined between the charge casing 30 and the cavity liner 32. The charge casing 30 may be formed by the body 14 of the perforating gun assembly 10 or, alternatively, may be a separate component which is inserted into the body 14 of the perforating gun assembly 10.

The inner bore 20 extends through the body 14 from the first axial end surface 24 to the second axial end surface 26 thereby providing an axially extending internal passage through the entirety of the perforating gun assembly 10. In various embodiments, the charge cavity 34 of each explosive charge 28 may be in fluid communication with the inner bore 20 at a base end 36 of the explosive charge 28. In various other embodiments, the inner bore 20 and the charge cavity 34 may be separated by a barrier 50 (e.g., a thin layer of adhesive tape such as aluminum tape) disposed at the base end 36 of the explosive charge 28 (see, e.g., FIGS. 2-4). The inner bore 20 and the charge cavities 34 of each explosive charge 28 may contain an explosive material 38.

A variety of different explosive materials 38 may be used with the present disclosure and the present disclosure is not, therefore, limited to any particular explosive material. Acceptable examples of explosive materials 38 include, but are not limited to, Cyclotrimethylenetrinitramine, C3H6N606 (sometimes referred to as "Royal Demolition Explosive" or "RDX"), cyclotetramethylene-tetranitramine (sometimes referred to as "High Melting Explosive" or "HMX"), Hexanitrostilbene (sometimes referred to as "HNS" or "JD-X"), and 2,6-Bis(Picrylamino)-3,5-dinitropyridine (sometimes referred to as "PYX").

The cavity liner 32 is configured to mate with the respective charge casing 30 of an explosive charge 28 so as to retain explosive material 38 within the respective charge cavity 34. The cavity liner 32 may also form a seal that prevents well materials or environmental conditions from interacting with the explosive material 38. For example, the explosive material 38 may be environmentally sealed within the charge cavity 34 in order to prevent or inhibit degradation of the explosive material 38 by moisture/humidity. For example, the cavity liners 32 shown in FIGS. 1-4 are configured as concave shaped disks (e.g., conical, partispherical, parabolic, etc.), with the "peak" of the disk pointing toward the base end 36 of the explosive charge 28. However, the present disclosure is not limited to any particular cavity liner 32 configuration.

Figure 2:
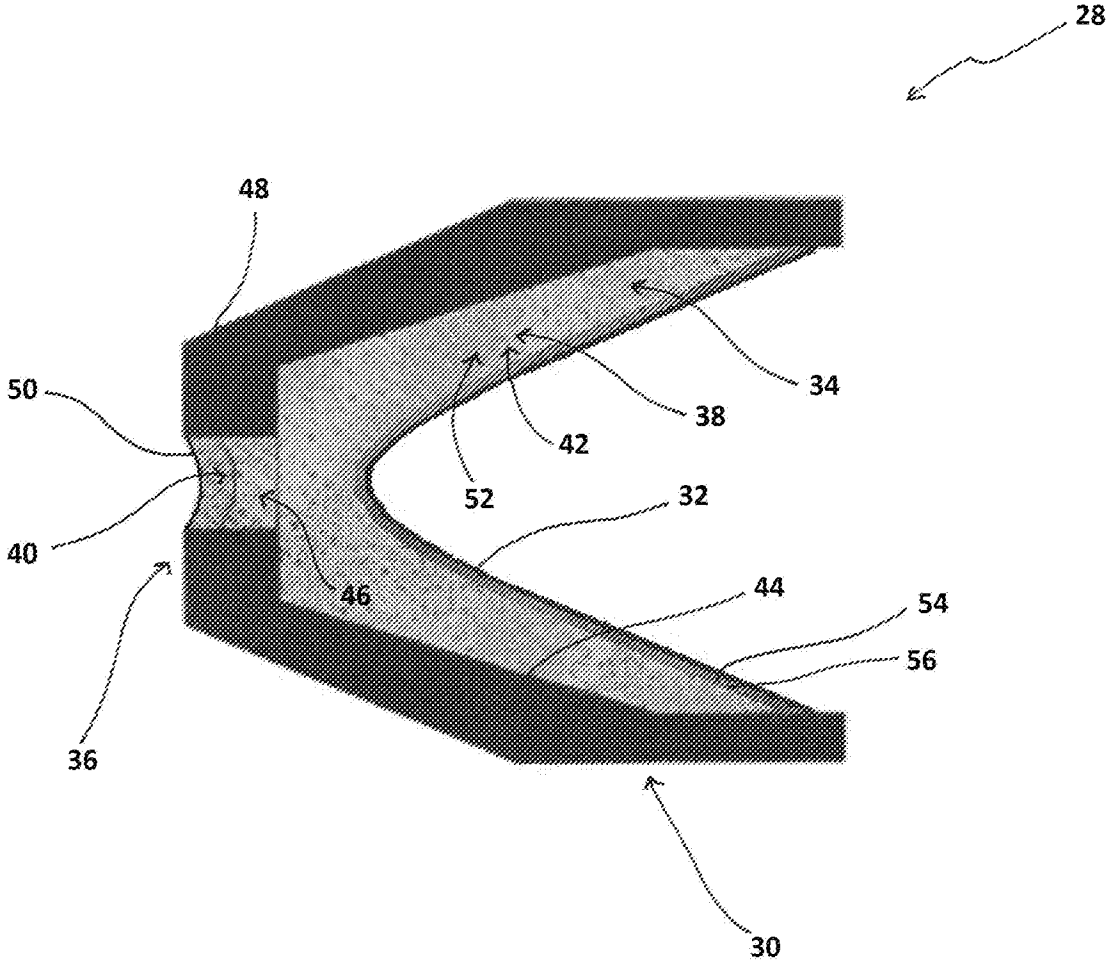
FIG. 2 illustrates an explosive charge, in accordance with one or more embodiments of the present disclosure.
Figure 3:
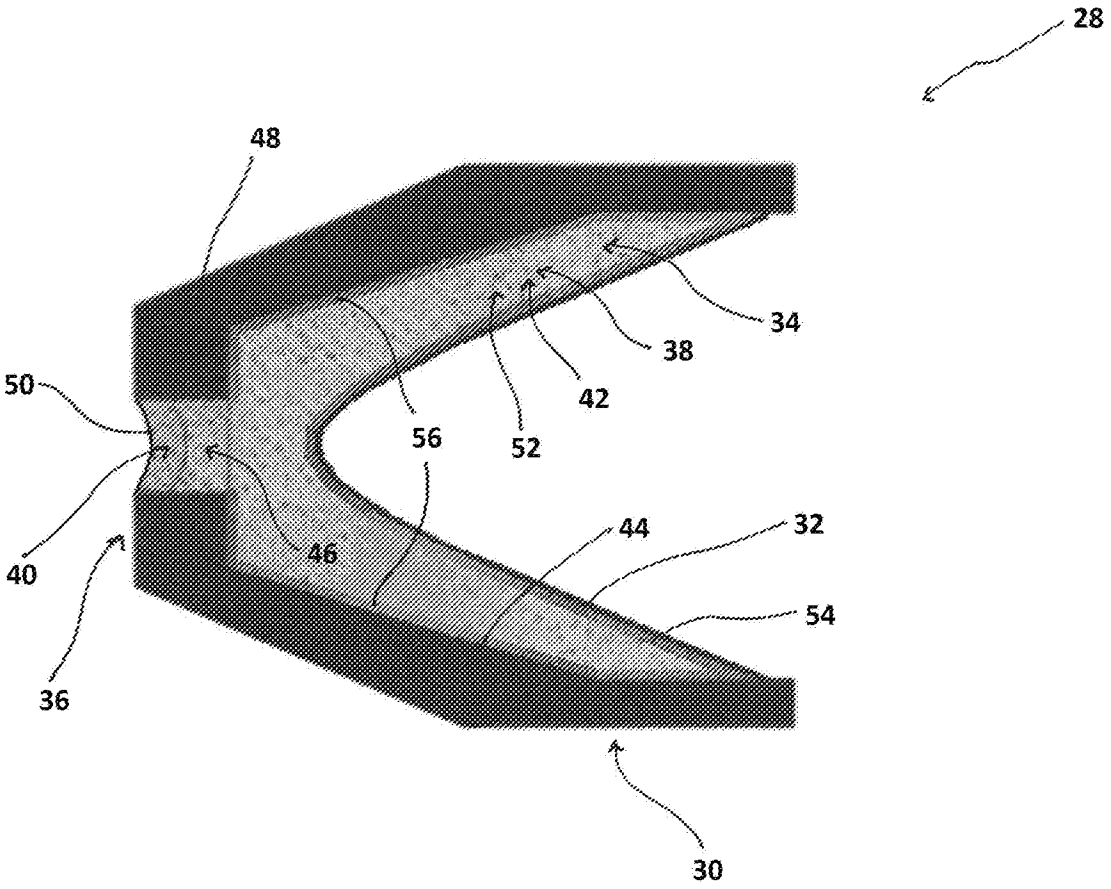
FIG. 3 illustrates an explosive charge, in accordance with one or more embodiments of the present disclosure.
Figure 4:
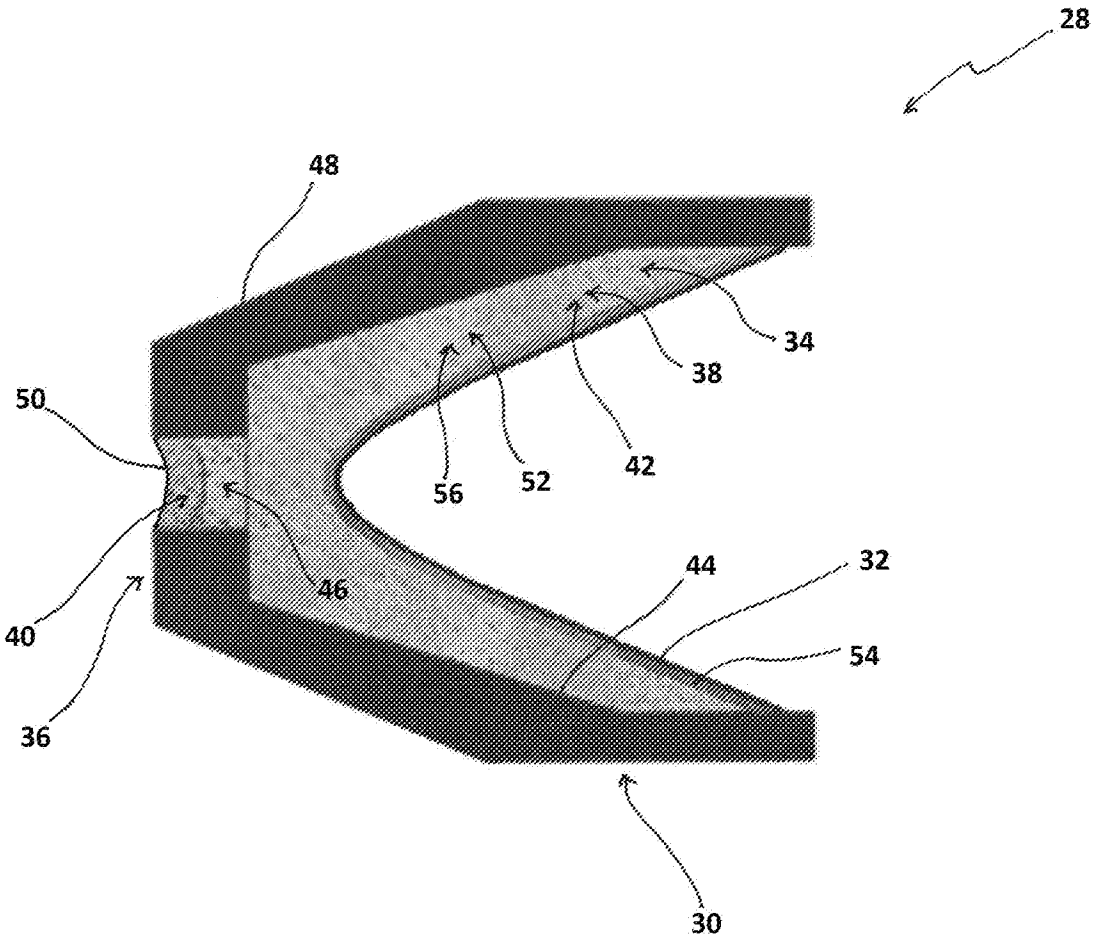
FIG. 4 illustrates an explosive charge, in accordance with one or more embodiments of the present disclosure.

Referring to FIGS. 2-4, the charge casing 30 of the explosive charge 28 contains the explosive material 38 which may include, for example, a priming charge 40 and a main charge 42. The charge casing 30 includes an interior surface 44 defining a portion of a boundary of the charge cavity 34. The charge casing 30 may further include an aperture 46 extending from the interior surface 44, at the base end 36 of the explosive charge 28, through the charge casing 30. The aperture 46 may, for example, extend through an exterior surface 48 of the charge casing 30. In various embodiments, the barrier 50 may be applied to the interior surface 44 or the exterior surface 48 of the charge casing 30 so as to cover the aperture 46. The barrier 50 and the cavity liner 32 may seal the explosive material 38 within the charge cavity 34. While discussed above with respect to the perforating gun assembly 10, it should be understood that the explosive charge 28 may be independent of the perforating gun assembly 10 and may also be used in other types of explosive devices.

The charge cavity 34 and the aperture 46 may contain the explosive material 38. As discussed above, the explosive material 38 may include, for example, the priming charge 40 and the main charge 42. In various embodiments, the priming charge 40 may be located within the aperture 46 while the main charge 42 may be located within the charge cavity 34. In various embodiments, the main charge 42 may include a binder 52 intermixed with the explosive material 38 of the main charge 42. The binder 52 may be formed from, for example, a wax, a polymer, or any other material suitable as a binder for an explosive material. The explosive charge 28 may further include an adhesive 54 disposed between and in contact with the explosive material 38 and the cavity liner 32. The adhesive 54 may be used to adhere the cavity liner 32 to the explosive material 38. An example of a material which may be suitable for the adhesive 54 may be an alkyd enamel such as, for example, the insulating alkyd enamel GLYPTAL 1201A manufactured by Glyptal Inc. of Chelsea, Mass. The contents of the charge cavity 34 (e.g., the explosive material 38, the binder 52, and the adhesive 54) may be pressed together within the charge cavity 34 to obtain an increased density of the explosive material 38.

In some cases, it may be desirable to deactivate the explosive charge 28 so as to avoid the expenses associated with continued storage or conventional disposal (e.g., controlled detonation) of the explosive charge 28. Accordingly, the explosive charge 28 may include a deactivating composition 56 retained within the charge cavity 34. The deactivating composition 56 is configured to deactivate all or a substantial portion of at least the main charge 42 so as to deactivate the explosive charge 28. As used herein, the term "deactivate" means to render the explosive material 38 within the explosive charge 28 and, hence, the explosive charge 28 itself, incapable of detonation by the typical method(s) of initiating a detonation of the particular explosive charge 28. Once the explosive charge 28 has been deactivated, the explosive charge 28 may no longer require disposal by conventional methods or continued storage. The deactivating composition 56 may generally be stored with the explosive material 38 in the charge cavity 34 in an inactive state (e.g., a state in which the deactivating composition 56 will not deactivate the explosive material 38) or may be isolated from the explosive material 38 (e.g., by the binder 52 and/or the adhesive 54), in order to prevent an inadvertent deactivation of the explosive charge 28. Upon the occurrence of a predetermined condition, the deactivating composition 56 may interact with the explosive material 38, thereby deactivating the explosive charge 28. In various embodiments, the explosive charge 28 may be manufactured with the deactivating composition 56 present in the charge cavity 34 while in various other embodiments the deactivating composition 56 may be added to the charge cavity 34 after manufacturing (e.g., at a time when deactivation of the explosive charge 28 is desired).

Referring still to FIG. 2-4, in various embodiments, the adhesive 54 used to adhere the cavity liner 32 to the explosive material 38 may include the deactivating composition 56 (see FIG. 2). The deactivating composition 56 may be intermixed or otherwise included with the adhesive 54 and sprayed or otherwise applied to the explosive material 38 in the charge cavity 34 prior to installation of the cavity liner 32. In various embodiments, the deactivating composition 56 may be applied directly to the charge casing 30. For example, as shown in FIG. 3, the deactivating composition 56 may be applied to the interior surface 44 of the charge casing 30 in contact with the explosive material 38. In various embodiments, the deactivating composition 56 may be intermixed with the adhesive 54 and sprayed or otherwise applied to the interior surface 44 of the charge casing 30. In various embodiments, the binder 52 may include the deactivating composition 56 (see FIG. 4). Various embodiments of the explosive charge 28, discussed above with respect to the deactivating composition 56 in FIGS. 2-4, may be used independently or in combination in an explosive charge 28. For example, in various embodiments, it may be desirable to increase a contact surface area between the deactivating composition 56 and the explosive material 38 by disposing the deactivating composition 56 at multiple locations (e.g., on the interior surface 44, in the adhesive 54, and/or in the binder 52) within the charge cavity 34.

The deactivating composition 56 may be configured to deactivate all or a substantial portion of the main charge 42 through direct interaction or indirect interaction (e.g., interaction with a product of the deactivating composition 56) between the deactivating composition 56 and the explosive material 38 of the main charge 42. The interaction between the deactivating composition 56 and the explosive material 38 which deactivates the explosive material 38 may be, for example, a chemical interaction. The deactivating composition 56 may include one or more biological and/or non-biological constituents. In various embodiments, the explosive charge 28 may include two or more different deactivating compositions 56 (e.g., deactivating compositions 56 each containing different biological and/or non-biological constituents).

In various embodiments, the deactivating composition 56 may include one or more biological constituents such as, for example, one or more types of microorganisms. The microorganisms may produce one or more enzymes which may chemically interact with the explosive material 38 of the explosive charge 28, thereby deactivating the explosive charge 28. In various embodiments, a microorganism constituent of the deactivating composition 56 may be a bacteria which may produce one or more enzymes capable of deactivating the explosive material 38 during growth (e.g., reproduction) of the bacteria. Examples of suitable bacteria may include, but are not limited to, *Pseudomonas* spp., *Escherichia coli, Morganella morganii, Rhodococcus* spp., and *Comamanos* spp. In various embodiments, a bacteria used in the deactivating composition 56 may be a thermophile (e.g., a type of bacteria which may thrive at relatively high temperatures compared to other bacteria) such as, for example, *Geobacillus stearothermophilus*. In various embodiments, the deactivating composition 56 may additionally or alternatively include one or more non-biological constituents such as those conventionally known in the art to be capable of deactivating an explosive material. Examples of suitable non-biological constituents may include, but are not limited to, various cleaning detergents (e.g., those containing nonylphenol ethoxylate oligomer, sodium alkyl naphthalene sulfonate, etc.), sodium hydroxide, superoxide salts, sodium percarbonate, etc.

As previously discussed, upon the occurrence of a predetermined condition, the deactivating composition 56 may interact with the explosive material 38, thereby deactivating the explosive charge 28. In various embodiments, occurrence of the predetermined condition may cause degradation of the binder 52 and/or the adhesive 54, thereby allowing the deactivating composition 56 included in the binder 52 and/or the adhesive 54 to contact or otherwise interact with the explosive material 38. For example, in various embodiments, the binder 52 or the adhesive 54 may be configured to degrade (e.g., melt, decompose, etc.) as a function of time or based on exposure to one or more environmental conditions such as heat, atmospheric gas composition, moisture, etc. In order to initiate deactivation of the explosive charge 28, the explosive charge 28 may be introduced to the predetermined condition(s) necessary to effect degradation of the binder 52 and/or the adhesive 54.

In various other embodiments, degradation of the binder 52 and/or the adhesive 54 may not be necessary to cause the deactivating composition 56 to interact with the explosive material 38. For example, the predetermined condition may be a condition which may cause the deactivating composition 56 to transition from a dormant state to an active state, thereby deactivating the explosive charge 28. Accordingly, in various embodiments, the deactivating composition 56 may be a microorganism, such as a bacteria, which is expected to grow when introduced to the predetermined condition. As previously discussed, the active bacteria may produce one or more enzymes capable of deactivating the explosive material 38.

In various embodiments, where the deactivating composition 56 is a thermophile bacteria, the deactivating composition 56 may have a deactivation temperature range within which the deactivation composition 56 will deactivate the explosive charge 28, by encouraging growth of the thermophile bacteria. Accordingly, exposing the explosive charge 28 to a predetermined temperature condition within the deactivation temperature range may initiate the deactivation of the explosive charge 28 (see Step 506 of Method 500; FIG. 5). The deactivating composition 56 may also have a storage temperature range within which the deactivating composition 56 will remain in a dormant state (e.g., the thermophile bacteria may be maintained in an endospore form which may allow the thermophile bacteria to remain in a dormant condition for very long periods of time, until conditions for growth are suitable). A maximum storage temperature (e.g., a threshold temperature) of the storage temperature range may be sufficiently below the deactivation temperature range such that inadvertent growth of the thermophile bacteria, during storage of the explosive charge 28, does not result in deactivation of the explosive charge 28. Accordingly, the explosive charge 28 may be stored or otherwise maintained in a temperature condition within the storage temperature range (e.g., at a temperature that is less than or equal to the maximum storage temperature) until deactivation the explosive charge 28 is required (see Step 504 of Method 500; FIG. 5). As will be understood by persons of skill in the art, the storage and deactivation temperature ranges associated with various types of bacteria and microorganisms will be different. For example, deactivation composition 56 including the *Geobacillus stearothermophilus* bacteria may have a deactivation temperature range which substantially corresponds to a growth temperature range of the bacteria of between 35° C. (95° F.) and 130° C. (266° F.) and may experience more effective growth between, for example, 50° C. (122° F.) and 60° C. (140° F.). The *Geobacillus stearothermophilus* bacteria may experience little or no growth below 35° C. (95° F.). Accordingly, the explosive charge 28 may be stored within a storage temperature range sufficiently below 35° C. (95° F.) to prevent inadvertent deactivation of the explosive charge 28.

In various embodiments, during use of the explosive charge 28, the explosive charge 28 may be exposed to the predetermined condition necessary to cause the deactivation composition 56 to transition from the dormant state to the active state. For example, insertion of perforating gun assembly 10, including the plurality of explosive charges 28, into a wellbore in preparation for detonation of the explosive charges 28 may expose the explosive charges 28 to the predetermined condition, for example, a temperature which is within the deactivation temperature range for the deactivation composition. As will be understood by persons of skill in the art, deactivation of the explosive charges 28 may occur over an amount of time which may be longer than the amount of time required to prepare the explosive charges 28 for detonation, thereby allowing the explosive charges 28 to be used without concern for inadvertent deactivation of the explosive charges 28 before they can be detonated.

Aspects of the present disclosure may provide an explosive charge, such as the explosive charge 28, which may be manufactured to modified to include a deactivation composition 56 sealed within the charge cavity 34 of the explosive charge 28 with the explosive material 38. The explosive charge 28 may be deactivated upon the occurrence of a predetermined condition which predetermined condition may occur naturally or may be initiated to effect an intentional deactivation of the explosive charge 28. Accordingly, expensive storage and/or disposal requirements for the explosive charge 28 and well as release of environmental contaminants as a result of the disposal may be avoided.

The detailed description of various embodiments herein makes reference to the accompanying drawings, which show various embodiments by way of illustration. While these various embodiments are described in sufficient detail to enable those skilled in the art to practice the inventions, it should be understood that other embodiments may be realized and that logical, chemical, and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A perforating gun assembly comprising:

a body having an axial length extending between a first axial end and a second axial end, an outer radial surface extending between the first axial end and the second axial end, and an inner bore; and at least one explosive charge extending from the outer radial surface to the inner bore, the at least one explosive charge comprising:

a charge casing;

a cavity liner mounted within the charge casing, the charge casing and the cavity liner defining a charge cavity there between;

an explosive material retained within the charge cavity; and a deactivation composition retained within the charge cavity;

wherein the charge cavity is in fluid communication with the inner bore.

2. The perforating gun assembly of claim 1, wherein the at least one explosive charge further comprises an adhesive disposed between and in contact with the explosive material and the cavity liner, the adhesive containing the deactivation composition.

3. The perforating gun assembly of claim 1, wherein the deactivation composition is disposed on an interior surface of the charge casing in contact with the explosive material.

4. The perforating gun assembly of claim 1, wherein the at least one explosive charge further comprises a binder intermixed with the explosive material, the binder containing the deactivation composition.

5. An explosive charge comprising:

a charge casing;

a cavity liner mounted within the charge casing, the charge casing and the cavity liner defining a charge cavity there between;

an explosive material retained within the charge cavity; and a deactivation composition retained within the charge cavity; and an adhesive disposed between and in contact with the explosive material and the cavity liner, the adhesive containing the deactivation composition.

6. The explosive charge of claim 5, wherein the deactivation composition is disposed on an interior surface of the charge casing in contact with the explosive material.

7. The explosive charge of claim 5, further comprising a binder intermixed with the explosive material, the binder containing the deactivation composition.

8. The explosive charge of claim 5, wherein the deactivation composition comprises a microorganism.

9. A method for deactivating an explosive charge, the method comprising:

providing the explosive charge comprising a charge casing and a cavity liner mounted within the charge casing, the charge casing and the cavity liner defining a charge cavity there between, the explosive charge further comprising an explosive material retained within the charge cavity; and deactivating the explosive charge with a deactivation composition retained within the charge cavity by causing the deactivation composition to transition from a dormant state to an active state;

wherein the explosive charge further comprises an adhesive disposed between and in contact with the explosive material and the cavity liner, the adhesive containing the deactivation composition.

10. The method of claim 9, wherein the deactivation composition has a deactivation temperature range within which the deactivation composition transitions to the active state.

11. The method of claim 10, wherein causing the deactivation composition to transition from a dormant state to an active state includes exposing the explosive charge to a temperature condition within the deactivation temperature range.

12. The method of claim 11, further comprising maintaining the explosive charge at a storage temperature less than the threshold deactivation temperature range prior to deactivating the explosive charge.

13. The method of claim 12, wherein the deactivation composition comprises a microorganism.

14. The method of claim 9, further comprising degrading the adhesive causing the deactivation composition to interact with the explosive material.

15. The method of claim 9, wherein the explosive charge further comprises a binder intermixed with the explosive material, the binder containing the deactivation composition.

16. The method of claim 15, further comprising degrading the binder causing the deactivation composition to interact with the explosive material.

* * * * *